US007371138B2

(12) United States Patent
Spass

(10) Patent No.: US 7,371,138 B2
(45) Date of Patent: May 13, 2008

(54) BOAT HAVING A PEDAL DRIVE

(76) Inventor: Klaus Spass, Rehmstrasse 2a, Hamburg (DE) 22299

( * ) Notice: Subject to any disclaimer, the term of this patent is extended or adjusted under 35 U.S.C. 154(b) by 165 days.

(21) Appl. No.: 10/555,492

(22) PCT Filed: May 13, 2004

(86) PCT No.: PCT/EP2004/005143

§ 371 (c)(1),
(2), (4) Date: Nov. 3, 2005

(87) PCT Pub. No.: WO2004/101355

PCT Pub. Date: Nov. 25, 2004

(65) Prior Publication Data

US 2006/0252315 A1 Nov. 9, 2006

(30) Foreign Application Priority Data

May 17, 2003 (EP) ..... 03011291

(51) Int. Cl.
*B63H 16/20* (2006.01)
*B63H 16/00* (2006.01)

(52) U.S. Cl. ..... 440/27; 440/21; 440/26; 440/31

(58) Field of Classification Search ..... 440/21–31
See application file for complete search history.

(56) References Cited

U.S. PATENT DOCUMENTS 1,834,397 A 12/1931 Hampton (Continued)

FOREIGN PATENT DOCUMENTS

DE 10048635 A 4/2002

*Primary Examiner*—Lars A. Olson
*Assistant Examiner*—Daniel V Venne
(74) *Attorney, Agent, or Firm*—David A. Guerra

(57) ABSTRACT

The invention relates to a pedal boat drive comprising at least one pedal crank and a drive train for transferring drive energy produced by the pedal crank to a means of propulsion, e.g. a propeller. At least one flywheel, which is mounted on a free-running axle, is placed in the drive train between the pedal crank and the means of propulsion. Drive energy produced by the pedal crank is transferred from the pedal crank to the flywheel, which is mounted in a free-running manner, and is transferred from said flywheel to the means of propulsion. The aim of the invention is to further develop a pedal boat drive of this type that enables a pedal boat to be used as an item of sports equipment. In doing this, the pedal boat should behave in water similar to a bicycle on land with regard to the feeling of riding. To this end, a switching mechanism for reversing the running direction of the means of propulsion while the direction of rotation of the pedal crank remains unchanged is placed in the drive train, and the pedal boat drive has two flywheels, which are mounted parallel to one another on the free-running axle while leaving an intermediate space therebetween. A take-off element is placed inside said intermediate space. This take-off element is connected to the means of propulsion, serves to transfer the drive energy and can be coupled as desired to one of the inner faces of both flywheels in order to transmit drive energy. The invention also relates to a pedal boat comprising a pedal boat drive of the aforementioned type.

17 Claims, 5 Drawing Sheets

U.S. PATENT DOCUMENTS 2,612,859 A 10/1952 Billman et al.
2,960,058 A * 11/1960 Magnani ..... 440/30
5,405,275 A * 4/1995 Schlangen et al. ..... 440/27
5,580,288 A * 12/1996 Marinc ..... 440/29
5,718,611 A * 2/1998 Schlangen et al. ..... 440/27
6,135,835 A * 10/2000 Lekhtman ..... 441/31
6,146,218 A * 11/2000 White ..... 440/30
6,165,029 A 12/2000 Lu
6,500,034 B1 * 12/2002 Lau ..... 440/21
6,855,016 B1 * 2/2005 Jansen ..... 440/6

* cited by examiner

BOAT HAVING A PEDAL DRIVE

CROSS-REFERENCE TO RELATED APPLICATIONS

This application is an U.S. national phase application under 35 U.S.C. §371 based upon co-pending International Application No. PCT/EP2004/005143 filed on May 13, 2004. Additionally, this U.S. national phase application claims the benefit of priority of co-pending International Application No. PCT/EP2004/005143 filed on May 13, 2004 and European Application No. 03011291.6 filed on May 17, 2003. The entire disclosures of the prior applications are incorporated herein by reference. The international application was published on Nov. 25, 2004 under Publication No. WO 2004/101355 A1.

FEDERALLY SPONSORED RESEARCH

Not applicable

SEQUENCE LISTING OR PROGRAM

Not applicable

BACKGROUND OF THE INVENTION

1. Field of the Invention

The invention relates to a pedal boat drive according to the generic clause of the claims in the present application. It further relates to a pedal boat equipped with a pedal boat drive of the aforementioned type.

2. Description of the Prior Art

A pedal boat drive is known from U.S. Pat. No. 6,165,029 as is a pedal boat equipped with such a drive. Although the prior art pedal boat permits storage of energy transmitted to the transmission train in a flywheel, it is not suited for a sports-related, flexible application.

Pedal boats are water borne vessels which have been known for a long time, serving primarily for pleasure. The pedal boats are in this context equipped with pedal boat drives, which by means of one or a plurality of pedal crank(s) transmit energy to a propulsion means, normally one or a plurality of propeller(s) or paddle wheel(s). The transfer of the drive energy takes place directly, i.e. the power is transferred to the propulsion means by the pedal crank(s) by way of a transmission means, e.g. a chain drive and/or a cardan shaft. In this way, in particular advancing and reversing of the pedal boat is controlled by the direction of rotation of the pedal cranks.

Examples of such pedal boats are known from the German utility model specifications DE 298 20 184 U1, DE 81 17 770 U1 and DE 84 04 297 U1.

In addition, a pedal boat comprising a drive means is known from DE 101 37 662 A1, wherein, in support of the propulsion means, an energy storage means, fed by the pedal drive, is provided in the transmission train, from which drive energy may be withdrawn, if so required, in order to bring about propulsion with reduced use of force. However, in this case as well the drive continues to be a direct one, the driving direction being determined by the direction of rotation of the pedal crank.

SUMMARY OF THE INVENTION

It is the object of the invention to so further develop a pedal boat drive that it enables a pedal boat to be used as an item of sports equipment. The pedal boat should in this context behave in water similarly to a bicycle on land with regard to the feeling of riding.

Due to the fact that a flywheel is mounted on a free-running axle in the transmission train, pedaling, with pedal cranks standing still, may be interrupted during a pedal boat ride, similarly to bicycle riding, without the pedal boat stopping immediately. The energy stored in the flywheel continues to propel the downstream portion of the transmission train and, in particular, the propulsion means, the boat continues to ride. The pedals are standing still in the course thereof; due to the free-running axle the portion of the transmission train preceding the flywheel is not driven by the energy stored therein.

A switching mechanism mounted in the transmission train for reversing the running direction of the propulsion means while the direction of rotation of the pedal cranks remains unchanged, permits simple and sporty maneuvering. In this manner, in particular the direction of propulsion of the propulsion means, for example a propeller, may be changed within the shortest possible time while pedaling of the pedal cranks continues. This, in contrast to known pedal boats, helps to considerably shorten the length of the brake path of a pedal boat equipped with such a drive by way of "thrust reversal", which is an essential property for fast pedal boats, used for sports purposes.

A switching mechanism of the aforesaid type is readily realized if, according to the invention, two flywheels are mounted parallel to one another, while leaving an intermediate space therebetween and if in the intermediate space a take-off element, e.g. a rubber-sheathed roller, is provided, optionally adapted to be coupled to the inner faces of the flywheels facing one another. Depending on which of the inner faces the take-off element engages, its direction of rotation and, consequently, also the direction of propulsion, changes while the direction of rotation of the flywheel and, as a result, of the pedal crank, remains unchanged. It goes without saying that instead of two flywheels mounted parallel to one another, a single flywheel may be provided, comprising a radial slot in which the take-off element is mounted. Apart from the two positions of the switching element coupled to one of the inner faces, it may take up yet another, third position, in which it engages none of the inner faces. This position is then a neutral or idling position.

The switching mechanism may advantageously be actuated by one or a plurality of pneumatic actuator(s), but other actuating mechanisms such as, for example, cable controls, are likewise conceivable. In the case of a rubber-sheathed roller serving as the take-off element, the said roller may e.g. be connected to a downstream cardan shaft in order to drive the propulsion means and be shifted into the respective switching position by two pneumatic actuators positioned diametrically opposite one another.

The pneumatic actuators may be mounted in a closed pneumatic system together with an adjusting lever for activating the said pneumatic actuators. Thus, no pressure storage needs be provided; by simply actuating the adjusting lever the pressure required at any given time is generated and applied to the actuator to be activated.

The selection of a free-running axle comprising a flywheel also permits the mounting of a dual-ratio or multiple ratio transmission gear mechanism, preferably in the axle, in the fashion of a hub gear drive mechanism known from bicycle technology. In this way, the pedal boat equipped with a drive according to the invention may be used as an item of sports equipment in a plurality of gears, like a bicycle.

In order to adjust the driving properties of the pedal boat, approximating them, for example, to those of a bicycle on land, the mass of the flywheel(s) is selected accordingly. In this case, a total mass of the flywheel(s) of 50 to 100 kg, in particular 60 to 80 kg, is preferred.

For a sporty and maneuverable ride with the pedal boat, a boat comprising a twin hull (along the lines of a catamaran) is preferred in a pedal boat equipped with a drive according to the invention.

Finally, the pedal boat may be provided with a means for accommodating a conventional bicycle and integration of the latter into the transmission train. For this purpose, a roller may, for example, use the propulsion energy produced by the bicycle on its rear wheel and then transmit it to the flywheel in the further progression of the transmission train.

BRIEF DESCRIPTION OF THE DRAWINGS

Further advantages and characteristics of the invention are apparent from the description which follows by way of the accompanying figures. There is shown in.

The figures are schematic illustrations and are neither complete nor according to scale. In the figures identical parts are denoted by identical reference numerals.

DESCRIPTION OF THE PREFERRED EMBODIMENT

Figure 1:
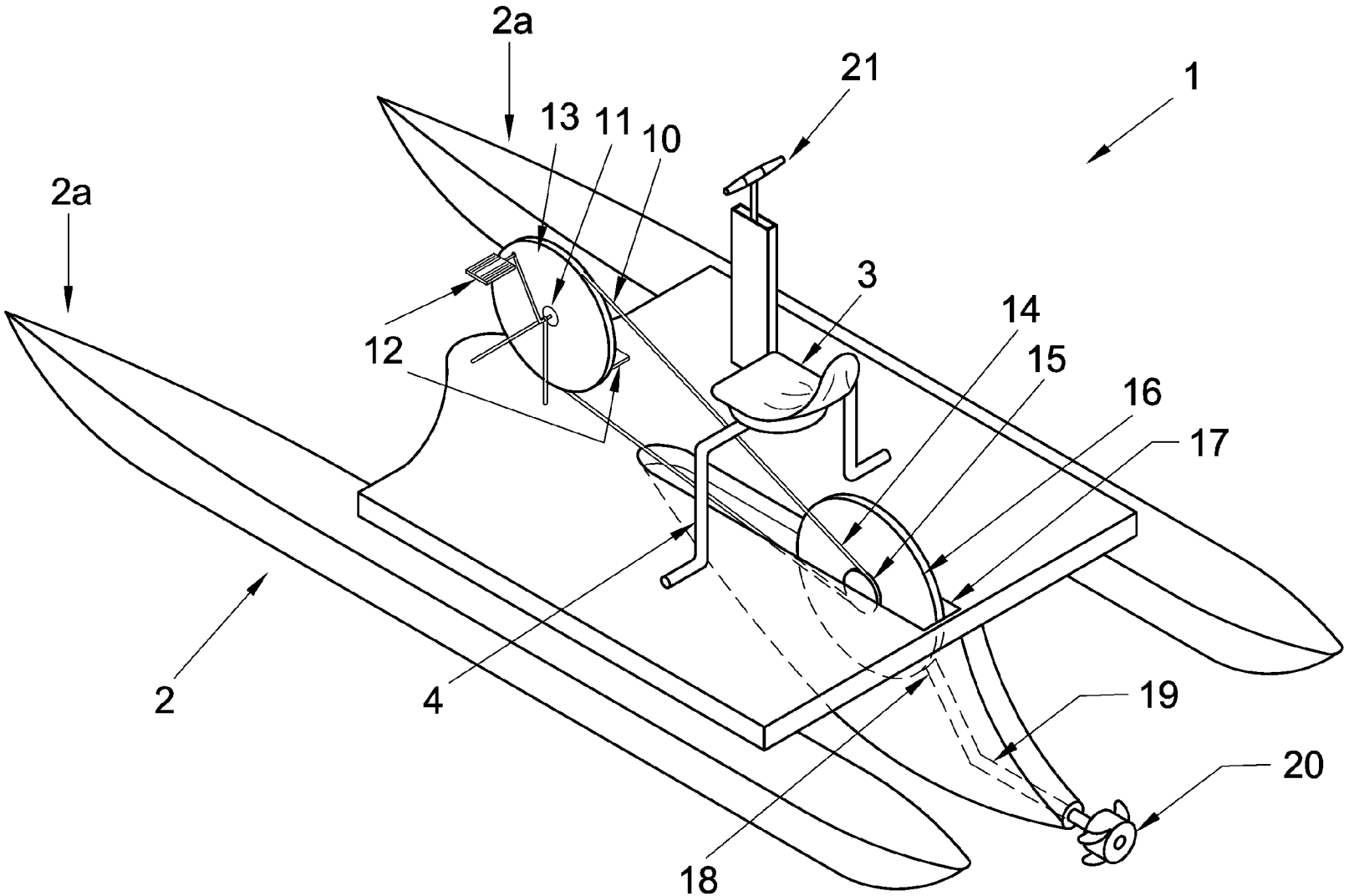
FIG. 1 a pedal boat comprising a drive mechanism according to the invention shown schematically in a perspective view, FIGS. 2*a* and 2*b* the portion of the pedal boat drive comprising the flywheel as well as the take-off element and the on-following transmission train up to the propeller in two schematic side elevations, FIG. 3 the portion shown in FIGS. 2*a* and 2*b* in a schematic view from above and FIG. 4 a view similar to the one shown in FIG. 3, in which case the pneumatic switching of the switching actuators comprising the adjusting lever in a closed circuit is shown schematically.

FIG. 1 schematically shows a pedal boat 1. The latter comprises the body of a boat 2, which is formed by a twin hull consisting of two hulls 2*a* connected via a connecting platform 2*b*. On the connecting platform 2*b* a bucket seat 3 is fitted to a frame 4. A drive 10 is mounted along the connecting platform 2*b*. The said drive comprises a rigidly mounted pedal crank 11 comprising pedals 12. A gearwheel 13 is fitted to the pedal crank 11, transmitting energy generated by the pedal crank 11 to a further gearwheel 15 via a transmission chain 14 running on the said gearwheel. The latter is connected to a double flywheel 16 mounted on the free-running axle in order to transmit forces. In a slot 17 formed in the double flywheel 16 a take-off element in the form of a rubber-sheathed roller 18 is mounted, serving to transmit the drive energy to a cardan shaft 19 and from there to a propeller 20. Finally, an adjusting lever 21 may be seen, serving to switch the direction of propulsion in a manner which will be described in more detail further below.

The portion of the transmission train close to the propeller may be seen better in FIGS. 2-4 and is elucidated in the following with reference to those figures.

Figure 2A:
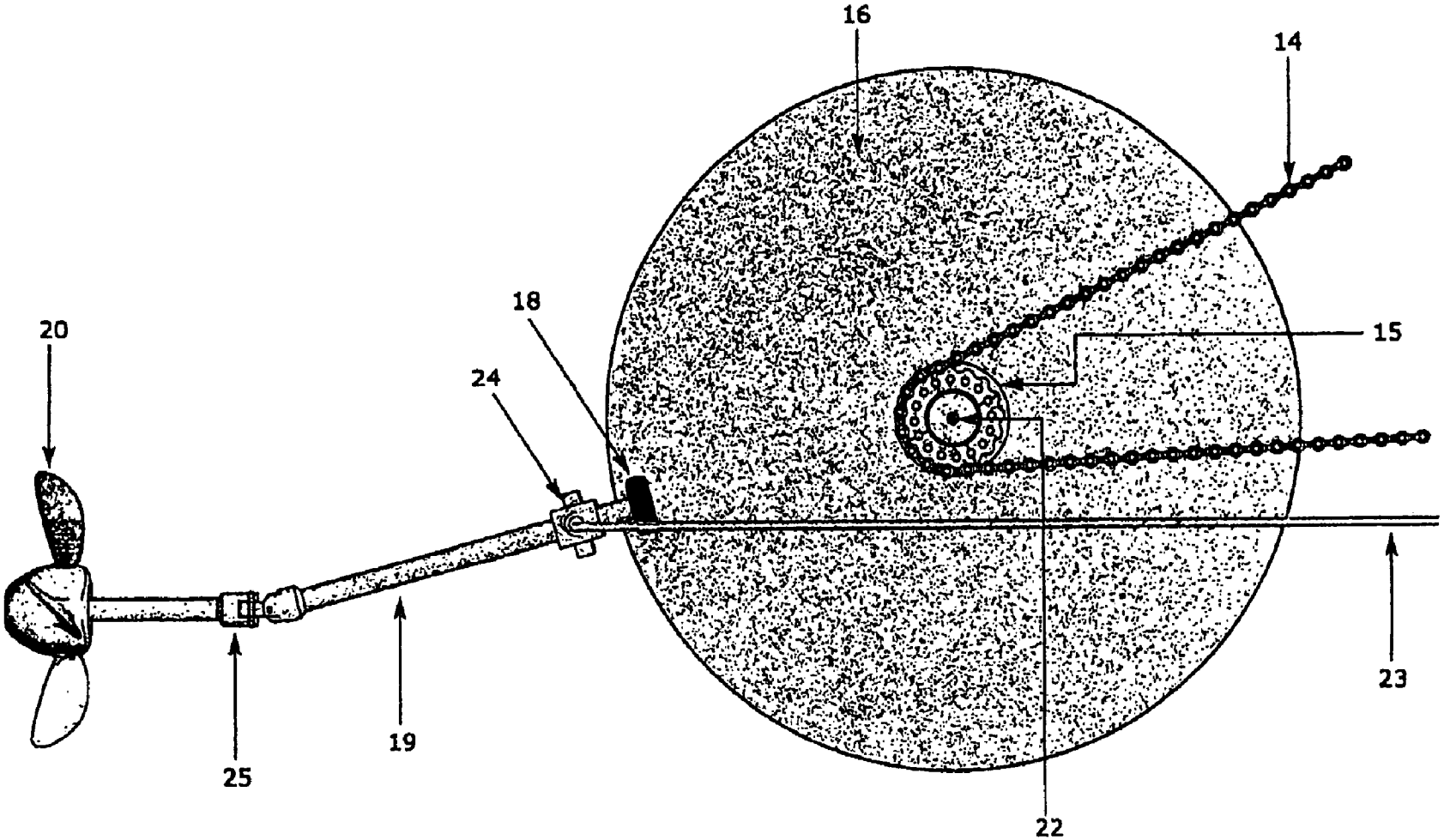
Figure 2B:
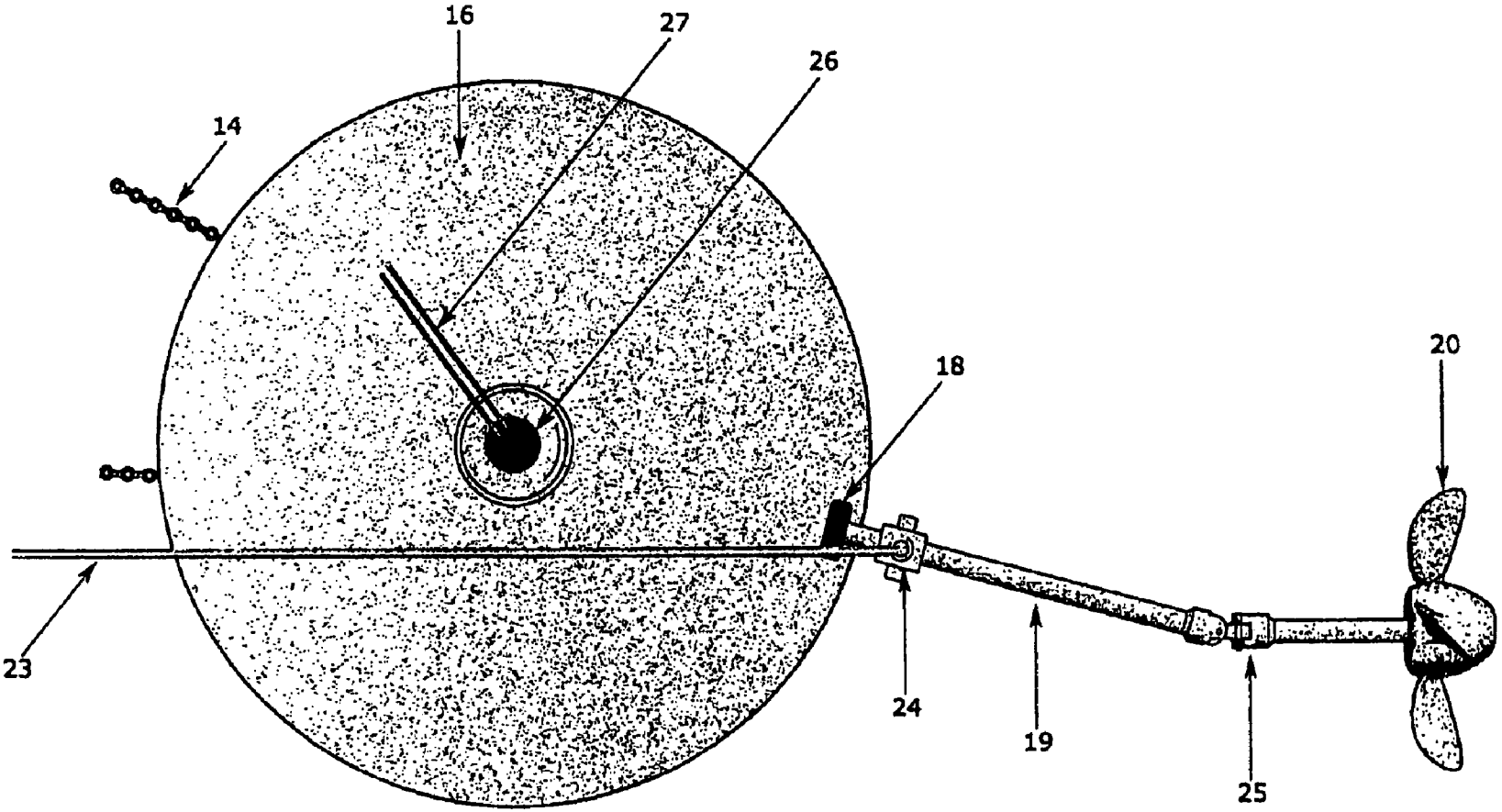

FIGS. 2*a* and 2*b* show two schematic side elevations of this portion. Apart from the already described elements, further elements of the pedal boat drive 10 according to the invention are shown there. Thus, 22 denotes the free-running axle, on which the double flywheel 16 is mounted. In addition, pneumatic actuators 24 connected via pneumatic ducts 23 to the adjusting lever 21 (not shown) may be seen. These engage the cardan shaft 19 connected to the rubber-sheathed roller 18, in order to be able to adjust the said cardan shaft and, consequently, the roller 18 in the intermediate space 17. For this purpose an articulation 25 is provided in the cardan shaft 19 so that the propeller 20 does not change its orientation when the cardan shaft 19 is adjusted.

Moreover, a transmission gear mechanism as well as a transmission control means 27 may be seen in FIG. 2*b* indicated at 26. By means of the transmission gear 26—similar to a hub gear in a bicycle—the transmission ratio of the transmission and likewise, therefore, a "drive level" may be selected. As a result, this affords the possibility of sporty riding and is only possible because of the free-running axle 22, integrated into the transmission train, comprising the double flywheel, 16.

Figure 3:
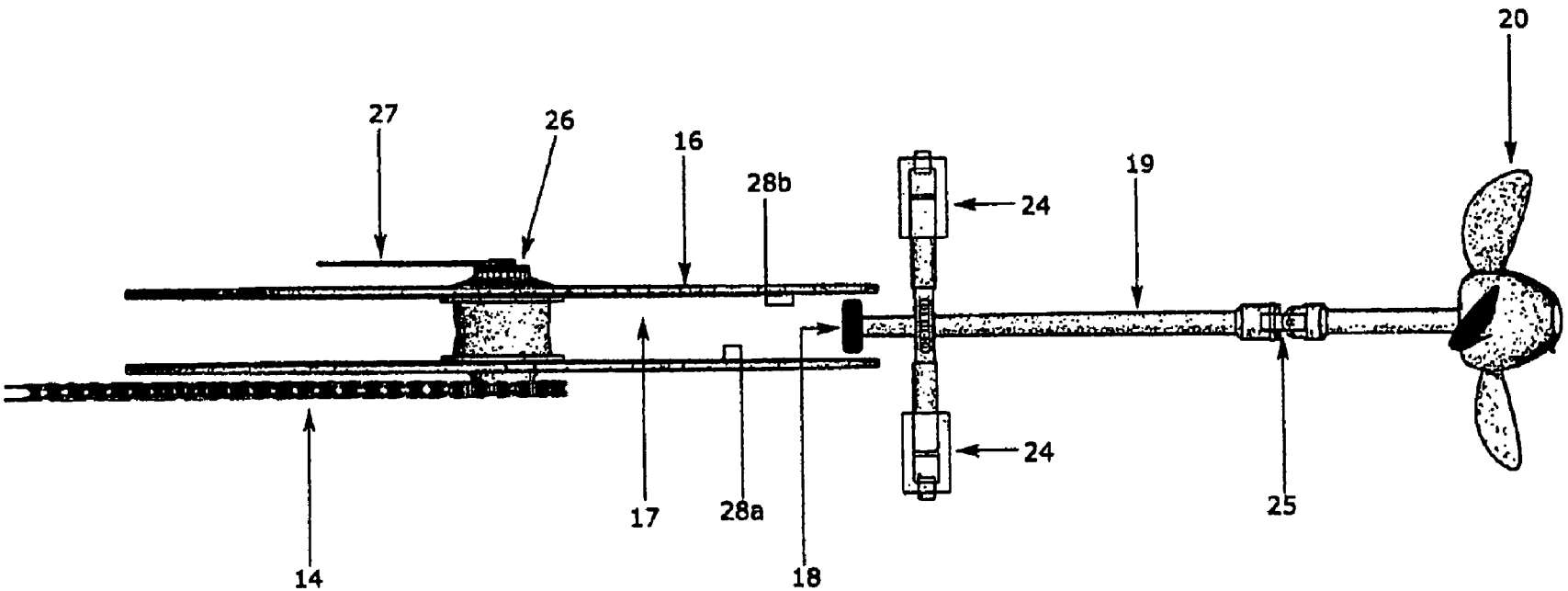
Figure 4:
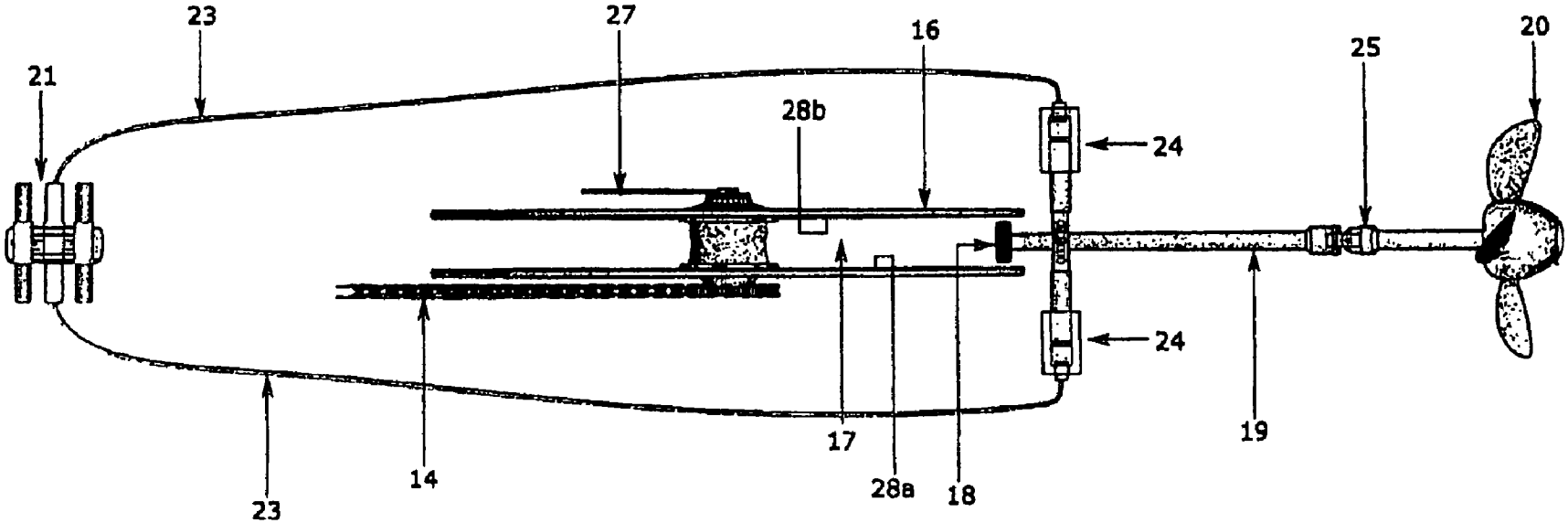

The above described switching mechanism can be better seen in FIGS. 3 and 4. There, the rubber-sheathed roller 18, situated in the intermediate space 17 of the double flywheel 16, is in each case shown in a central position, in which it does not engage either of the inner faces 28*a*, 28*b* of the double flywheel 16, i.e. it is shown in an idling position. By actuating the adjusting lever 21, the rubber-sheathed roller 18 is brought into frictional engagement with one of the inner faces 28*a*, 28*b*. This brings about a force transmission from the double flywheel 16 to the propeller 20. Depending on the inner face 28*a*, 28*b* against which the roller 18 abuts, the direction of rotation of the latter and, as a result, the direction of rotation of the propeller 20 changes and, ultimately, the direction of motion of the pedal boat 1.

FIG. 4 schematically shows the adjusting lever 21 in three positions, forward position, idling position and reversing position.

Of course, appropriate hydraulic elements may be provided instead of the pneumatic actuators 24 and pneumatic ducts 23.

The pedal boat drive according to the invention provides, for the first time, the possibility to use a pedal boat not only as an item of leisure equipment, but as a true item of sports equipment, similar to a bicycle, for example a mountain bike.

LIST OF REFERENCE NUMERALS

1 Pedal boat
2 Boat body
2*a* Hull
2*b* Connecting platform
3 Bucket seat
4 Frame
10 Drive
11 Pedal crank
12 Pedals
13 Gearwheel
14 Transmission chain
15 Gearwheel
16 Double flywheel
17 Slot
18 Rubber-sheathed roller
19 Cardan shaft
20 Propeller
21 Adjusting lever
22 Free-running axle
23 Pneumatic duct
24 Pneumatic actuator
25 Articulation

26 Transmission
27 Gear Control
28*a* Inner face
28*b* Inner face

The invention claimed is:

1. A pedal boat drive system, comprising:

a boat body;

at least one pedal crank;

a propulsion means;

a transmission train for transmitting drive energy produced by said pedal crank to said propulsion means, said transmission train having a free-running axle;

at least one flywheel being mounted on said free-running axle in said transmission train between said pedal crank and said propulsion means;

a switching mechanism for reversing the running direction of said propulsion means while the direction of rotation of said pedal cranks remains unchanged, said switching mechanism placeable in said transmission train; and a multiple ratio transmission gear mountable in said transmission train.

2. The pedal boat drive system as set forth in claim 1, wherein said flywheel being two flywheels mounted parallel to one another on said free-running axle, said flywheels define an intermediate space, said flywheels having an inner face.

3. The pedal boat drive system as set forth in claim 2 further comprising a take-off element mountable in said intermediate space connectable to said propulsion means and serving to transmit the drive energy, said take-off element being adapted to be coupled at will to either of said inner faces of said two flywheels in order to transmit the energy.

4. The pedal boat drive system as set forth in claim 3, wherein said take-off element is a roller, said roller having an outer rubber-sheathing for frictional engagement on either of said inner faces of said flywheels.

5. The pedal boat drive system as set forth in claim 1 further comprising at least one pneumatic actuator for actuating said switching mechanism.

6. The pedal boat drive system as set forth in claim 5, wherein said pneumatic actuator is connectable to an adjusting lever in a closed pneumatic duct system, said pneumatic actuator pneumatically actuates said switching mechanism in order to adjust the direction of running of said propulsion means.

7. The pedal boat drive system as set forth in claim 1, wherein said multiple ratio transmission gear is mountable in said free-running axle.

8. The pedal boat drive system as set forth in claim 1, wherein said flywheel has a total mass of 50 to 100 kg.

9. The pedal boat drive system as set forth in claim 1, wherein said flywheel has a total mass of 60 to 80 kg.

10. The pedal boat drive system as set forth in claim 1, wherein said boat body has at least two hulls.

11. The pedal boat drive system as set forth in claim 1, wherein said propulsion means is a propeller.

12. A pedal boat drive system, comprising:

a boat body;

at least one pedal crank;

a propulsion means;

a transmission train for transmitting drive energy produced by said pedal crank to said propulsion means; said transmission train having a free-running axle;

at least two flywheels mounted parallel to one another on said free-running axle, said flywheels define an intermediate space, said flywheels having an inner face;

a take-off element mountable in said intermediate space connectable to said propulsion means and serving to transmit the drive energy, said take-off element being adapted to be coupled at will to either of said inner faces of said two flywheels in order to transmit the energy; and a switching mechanism for reversing the running direction of said propulsion means while the direction of rotation of said pedal cranks remains unchanged, said switching mechanism placeable in said transmission train.

13. The pedal boat drive system as set forth in claim 12, wherein said take-off element is a roller, said roller having an outer rubber-sheathing for frictional engagement on either of said inner faces of said flywheels.

14. The pedal boat drive system as set forth in claim 12 further comprising at least one pneumatic actuator for actuating said switching mechanism.

15. The pedal boat drive system as set forth in claim 14, wherein said pneumatic actuator is connectable to an adjusting lever in a closed pneumatic duct system, said pneumatic actuator pneumatically actuates said switching mechanism in order to adjust the direction of running of said propulsion means.

16. The pedal boat drive system as set forth in claim 12 further comprising a multiple ratio transmission gear mountable in said transmission train, said multiple ration transmission gear being mountable in said free-running axle.

17. A pedal boat drive system, comprising:

a boat body;

at least one pedal crank;

a propulsion means;

a transmission train for transmitting drive energy produced by said pedal crank to said propulsion means; said transmission train having a free-running axle;

at least two flywheels mounted parallel to one another on said free-running axle, said flywheels define an intermediate space, said flywheels having an inner face;

a take-off element having a roller comprising an outer rubber-sheathing for frictional engagement on either of said inner faces of said flywheels, said take-off element being mountable in said intermediate space connectable to said propulsion means and serving to transmit the drive energy;

a switching mechanism for reversing the running direction of said propulsion means while the direction of rotation of said pedal cranks remains unchanged, said switching mechanism placeable in said transmission train; and at least one pneumatic actuator connectable to an adjusting lever in a closed pneumatic duct system for actuating said switching mechanism in order to adjust the direction of running of said propulsion means.

* * * * *